US005551902A

United States Patent [19]

Hubert et al.

[11] Patent Number: 5,551,902

[45] Date of Patent: Sep. 3, 1996

[54] EXTRUSION MOLDED ELECTRODE FORMED AS COMPOUND BODY AND A METHOD OF PRODUCING THE SAME

[75] Inventors: Hans Hubert, Priesendorf; Werner Langer, Litzendorf; Walter Wuest, Staffelstein; Stephan Weigel, Thurnau, all of Germany

[73] Assignee: Robert Bosch GmbH, Stuttgart, Germany

[21] Appl. No.: 298,324

[22] Filed: Aug. 29, 1994

[30] Foreign Application Priority Data

Aug. 27, 1993 [DE] Germany ..... 9312864 U

[51] Int. Cl.[6] ..... H01T 21/02

[52] U.S. Cl. ..... 445/7; 72/258

[58] Field of Search ..... 445/7, 49; 72/258

[56] References Cited

U.S. PATENT DOCUMENTS

| | | | |
|---|---|---|---|
| 3,803,892 | 4/1974 | Yamaguchi et al. | 445/7 |
| 4,314,392 | 2/1982 | Waite et al. | 445/7 |
| 4,526,551 | 7/1985 | Hoffmanner et al. | 72/258 |
| 4,575,343 | 3/1986 | Kin et al. | 445/7 |
| 5,310,373 | 5/1994 | Treiber et al. | 445/7 |

FOREIGN PATENT DOCUMENTS

| | | | |
|---|---|---|---|
| 3141649 | 9/1982 | Germany . | |
| 50-22972 | 8/1975 | Japan | 72/258 |
| 5-309411 | 11/1993 | Japan | 72/258 |

*Primary Examiner*—P. Austin Bradley
*Assistant Examiner*—Jeffrey T. Knapp
*Attorney, Agent, or Firm*—Michael J. Striker

[57] ABSTRACT

A compound electrode, in particular an electrode for a spark plug, has a core composed of a first electrically conductive material, and a casing deformed to surround the core and composed of a second electrically conductive material. The casing is formed in a single extrusion molding step that also shapes the core and simultaneously forms the cross-sectional profile of the electrode.

3 Claims, 3 Drawing Sheets

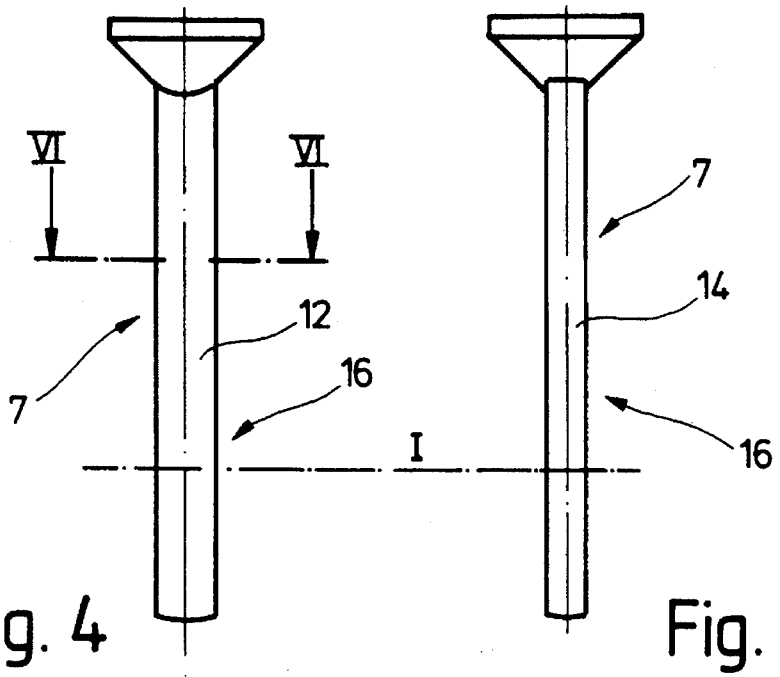
Fig. 4
Fig. 5
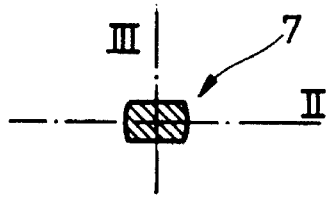
Fig. 6
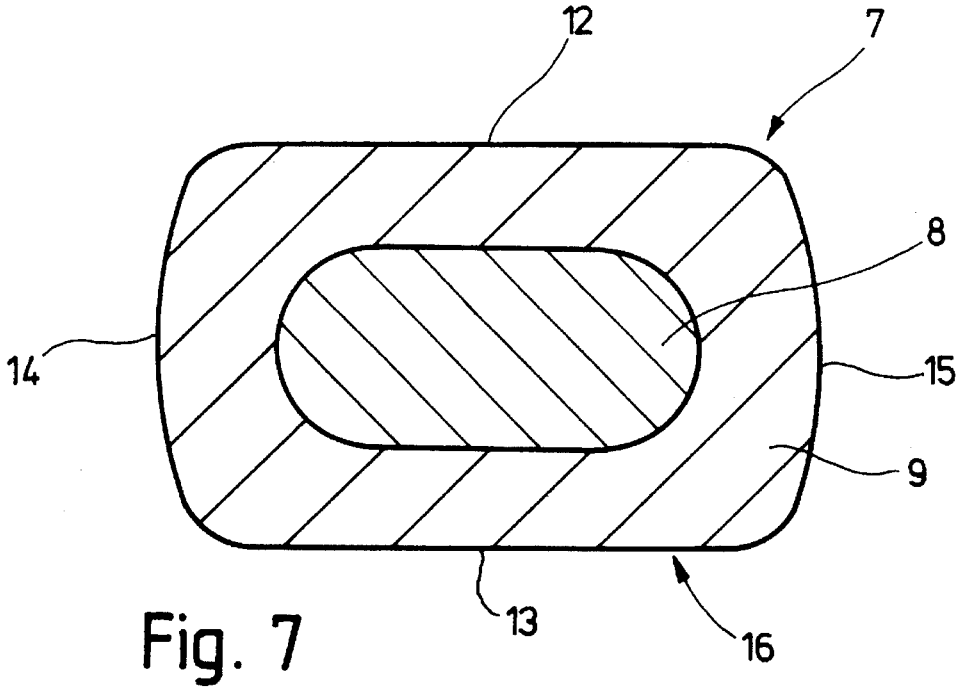
Fig. 7

EXTRUSION MOLDED ELECTRODE FORMED AS COMPOUND BODY AND A METHOD OF PRODUCING THE SAME

BACKGROUND OF THE INVENTION

The present invention relates to an extrusion molded electrode which is formed as a compound body, in particular for a spark plug for example a ground electrode for spark plug.

The German document DE-OS 31 41 649 discloses a spark plug electrode. It forms a central electrode of the spark plug, or in other words high voltage required for forming an ignition spark is supplied to it. The ignition spark, coming from the central electrode act upon, a so-called ground electrode which is connected with the electrical potential of the chassis of the vehicle. However, it is not limited to this application, but it can also be used for other electrodes as well. The known central electrodes and the ground electrodes disclosed in the above-mentioned literature are produced from metallic initial bodies, for example discs in extrusion process. They have an electrode cross-section profile which approximates the preferably rectangular shape and are provided with a core composed of a first, electrically conductive material and surrounded with a casing of a second, electrically conductive material. During a deformation process, namely the above mentioned extrusion molding, the core is provided with its casing and therefore a cylindrical composite body is produced. The core also has a cylindrical shape which is coaxially surrounded by the casing, so that together the above mentioned cylindrical shape is obtained. In a further working step a flat pressing is utilized and produces a cross-section profile which approximates a rectangular shape. Preferably, the pressing process produces flat upper and lower sides of the electrode and the side surfaces have correspondingly a convex shape. By the flat pressing step, the core assumes a substantially bone-shaped cross-sectional profile. The known electrode has been proven to be satisfactory in practice.

SUMMARY OF THE INVENTION

Accordingly, it is an object of the present invention to provide an extruded electrode formed as a compound body and a method of producing the same, which avoids the disadvantages of the prior art.

In keeping with these objects and with others which will become apparent hereinafter, one feature of the present invention resides, briefly stated, in an extrusion molded electrode formed as a compound body, in which the casing is arranged on the core by the same extrusion molding process with simultaneous shaping of the core and with simultaneous formation of the electrode cross-section profile.

When the electrode is formed in accordance with the present invention, the bottom thickness and/or the wall thickness of the casing remains constant due to the single performed extrusion molded process without a separate flat stamping. The wall thickness of the second, electrically conductive material is substantially uniform since, as seen in the cross-section, no bone-shaped profile is produced, but instead a substantially rectangular, preferably a substantially ellipsoidal core cross-section shape is obtained. The binding of the core material to the casing material is improved in accordance with the present invention since no additional mechanical deformation is provided, as in the case of the flat stamping in accordance with the prior art. The profile formation of the whole electrode is ideal, and rounded transitions are provided in it. The manufacturing accuracy of the inventive electrode is improved since the tool dimensions are exclusively decisive for its shaping. The extrusion molding process is performed controllably in the tools, whereby the dimension accuracy is guaranteed. Also, an optimal surface quality is obtained which has constant parameters. The unweighability of the welding connection with respect to a weldability, the flexibility and other phenomena occurring in the prior art due to the additional step of the flat stamping, are avoided in the present invention. All the above mentioned requirements and properties remain constant. The manufacturing safety in the present invention is increased since a simple formation over the manufacturing course is obtained and disturbances cannot occur. The heat withdrawal which is especially important for spark plug ground electrodes is improved since due to the cross-sectional profile of the core of the inventive electrode a higher material portion of the core can be obtained without the bone shape, and for example a material with higher heat conductivity is used. The composite body composed for example of two materials in the inventive electrode includes a casing which is formed in the same extrusion molding step simultaneously with the shaping of the core and also simultaneously with the formation of the electrode cross-sectional profile.

Preferably, it is proposed that the first material has a higher electrical conductivity than the second material. Especially the second material can be corrosion resistant, in particular has a high fire resistance. The first material for example has a high thermal conductivity. The first material can be for example copper, while the second material can be in particular nickel.

In accordance with a further feature of the present invention, a compound body is a body which is annealed after 10 the extrusion molding.

Preferably, the inventive electrode is a deformed compound body composed of two initial bodies of the first and second material, in particular discs. The deformation process is the above mentioned extrusion molding process performed as a single, working step.

As mentioned above, the core, similarly to the electrode cross-sectional profile (or in other words the whole profile) has a substantially rectangular, preferably somewhat ellipsoidal cross-sectional profile.

In particular, it can be provided that the core extends only over an electrode partial length so that the casing in a core-free region merges into a full profile. It is however also possible that after the manufacture of the extrusion molded electrode, the end portions are separated, and the electrode obtains its required length and then is welded to the spark plug housing. The electrode is bent after welding in a hook-shaped manner, so that one hook leg is connected with the ignition plug housing and the other hook leg is located opposite to the central electrode of the ignition plug.

Preferably the electrode has a flat upper surface and a flat lower surface. Both flat surfaces are produced, not as in the prior art, by a flat stamping process, but instead simultaneously with the extrusion molding. The extrusion molding also serves for imparting a shape to the core and surrounding it with the second material.

Preferably, the inventive electrode has side surfaces which extend transversely to its longitudinal extension and are convex. The upper and respectively the lower side merges into the associated side surface with formation of a radius. The convexly formed side surfaces are also preferably formed as radius surfaces.

It is also another feature of the present invention to provide a method of producing a compound electrode, in particular an electrode for a spark plug, which has a core of a first electrically conductive material and a casing deformed on the core to surround it and composed of a second electrically conductive material, the method comprises the single step of injection molding the casing on the core with simultaneous shaping of the core and simultaneous formation of a cross-sectional profile of the electrode.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a plan view of the upper surface of the inventive electrode;

FIG. 5 is a side view of the inventive electrode of FIG. 4;

FIG. 6 is a view showing a cross-section through the electrode along the line VI—VI in FIG. 4 shown schematically without details;

FIG. 7 is a view showing a cross-section through the electrode taken along the plane I in FIG. 4 or 5;

DESCRIPTION OF THE PREFERRED EMBODIMENTS

Figure 1:
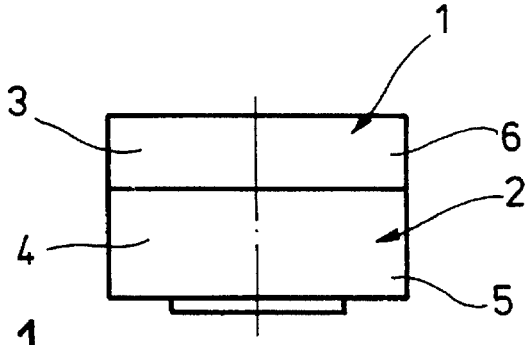
FIG. 1 is a view showing two initial bodies from which an electrode in accordance with the present invention is composed.

FIG. 1 shows a side view of two starting bodies 1 and 2 formed as discs 3 and 4. The disc 4 is composed of a first conductive material 5, such as copper, while the disc 3 is composed of a second, electrically conductive material 6, such as nickel.

An extrusion molded electrode 7 formed as a compound body 6 is produced by means of a corresponding extrusion molding matrix in a deformation process, namely a single extrusion molding step. It is used for example in ignition plugs as a ground electrode. As can be seen from FIG. 2, it has a longitudinally extending core 8 composed of the first material 5, for example copper. The second material 6, or in other words the disc 3, is formed in the above mentioned injection molding process as a casing 9 which surrounds the core 8. Furthermore, the extrusion molding head 10 and a free end region 11 are produced, in which the core 8 does not extend. The core 8 therefore extends only over a partial length, and the casing 9 in the free end region 11 is formed as a full profile composed for example of nickel.

Figure 3:
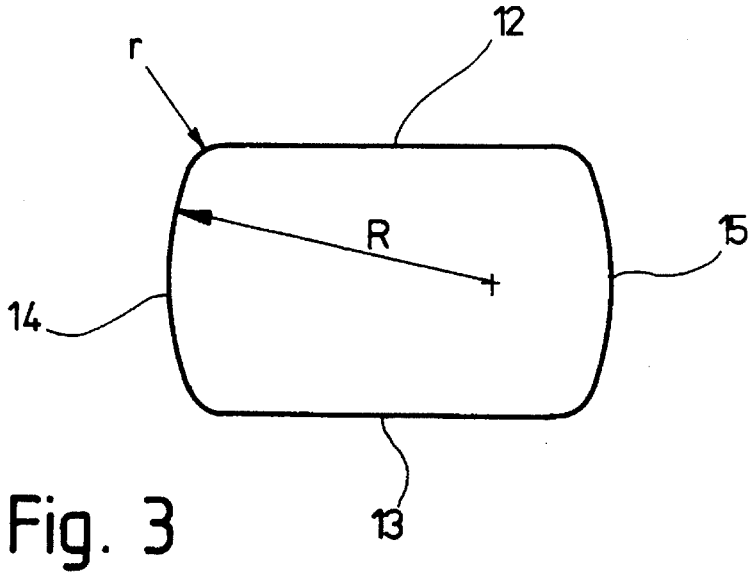
FIG. 3 is a view showing a cross-section of the inventive electrode.

The cross-sectional profile of the electrode is shown in FIG. 3. There the core 8 and the casing 9 are not identified, but instead the whole profile is shown. It can be seen that it has a substantially rectangular cross-sectional form. Due to the single above mentioned extrusion molding step, a flat upper side 12 and a flat lower side 13 are produced, and also convexly extending side surfaces 14 and 15 are formed. The upper and lower sides 12, 13 merge into the corresponding side surfaces 14 and 15 with formation of a radius r. The convex side surfaces 14 and 15 have a radius R.

FIG. 4 shows a view of the upper side 12 of the electrode 7. FIG. 5 shows the electrode 7 in the side view, or in other words as seen from the side surface 14. In FIG. 6, a schematic section of the electrode 7 along the line VI—VI of FIG. 4 is shown.

As can be seen from the consideration of FIG. 7, it shows a cross-section along the plane I of FIGS. 4 and 5. It can be seen that the core 8 has an elliptic cross-sectional profile, and the whole profile approximates a rectangle. The flat upper surface 12 and the flat lower surface 13 as well the convex side surfaces 14 and 15 are formed.

Figure 8:
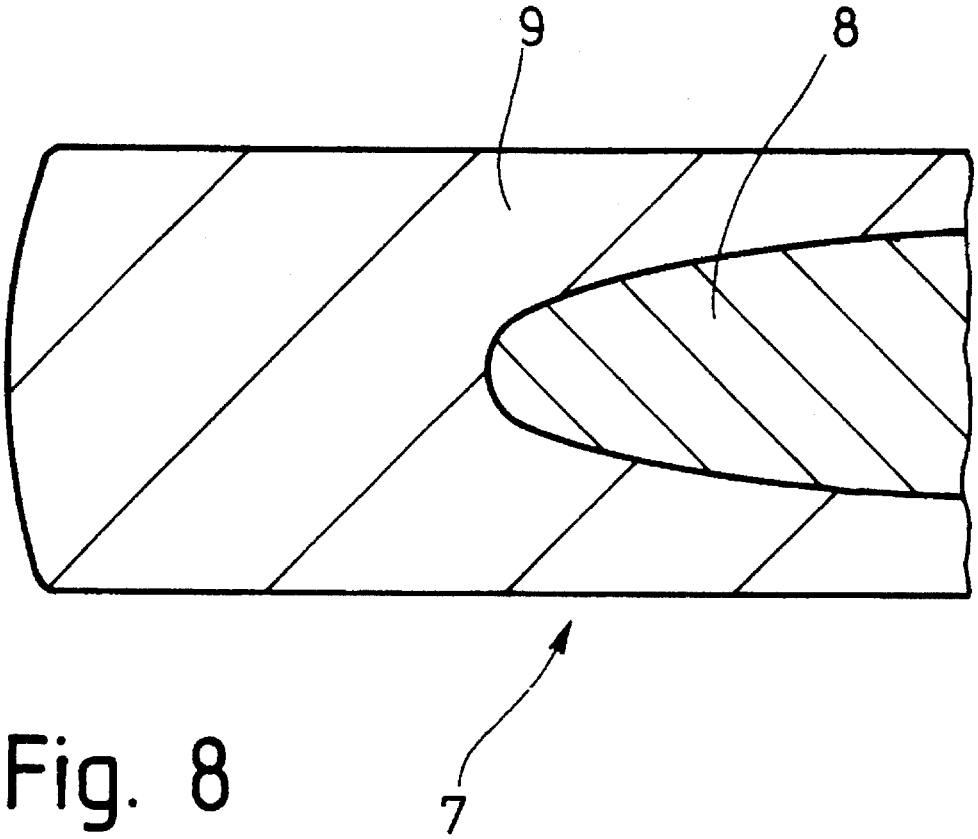
FIG. 8 is a view showing a longitudinal section through the electrode in the plane II in FIG. 6.
Figure 9:
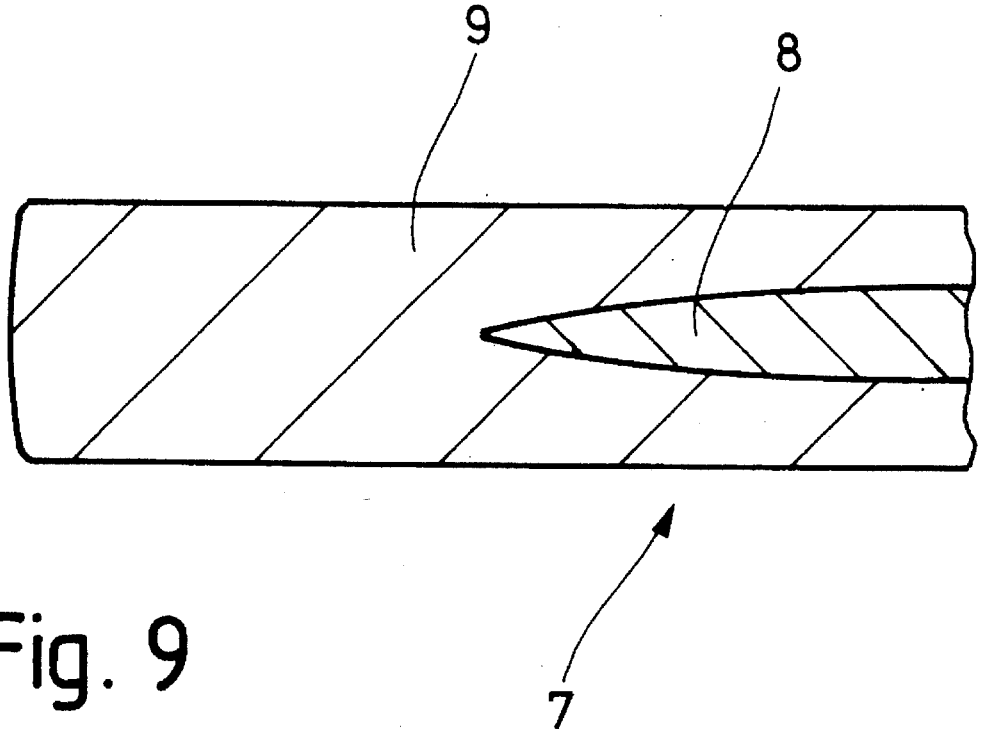
FIG. 9 is a view showing a longitudinal section through the inventive electrode taken in the plane III in FIG. 6.

FIG. 8 shows a longitudinal section in the region of the plane II in FIG. 6. FIG. 9 shows a longitudinal section in the plane III in FIG. 6. It can be recognized that the core has an ideal shape with round transitions. Toothed or multi-tip structures, as occurs in electrodes in accordance with the prior art, are not provided in the invention.

Figure 2:
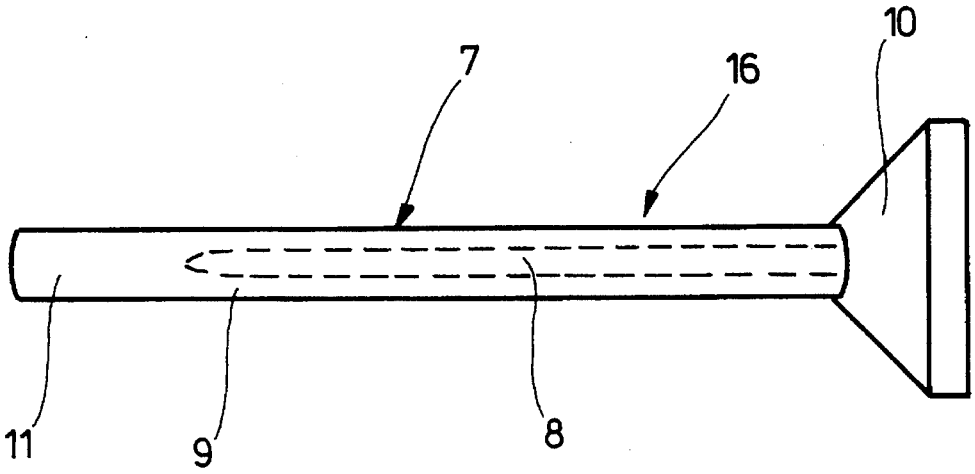
FIG. 2 is a view showing the extruded electrode in accordance with the present invention.

The inventive compound mass electrode can be produced very rationally by means of only single injection molding step for example from a copper/nickel-platinum as a starting part. In the above mentioned injection molding process the desired profile is produced. Since a single injection molding step is required, a quasi finished injection molding is utilized. The thusly produced electrode, as shown in FIG. 2, is subsequently annealed and then post-machined, for example sheared, for example for removing the head 10 and in some cases also a part of the end region 11. It can be performed after welding on the spark plug housing.

In accordance with the present invention the profiled body of the electrode is produced in a single working step. This provided a uniform wall thickness of the casing with ideal profile formation. Furthermore, a very high manufacturing accuracy and an extreme manufacturing safety is provided. With the single extrusion molding a very uniform grain distribution is obtained, in particular copper distribution, with a very high fraction of the first, in particular high heat conductive material, such as copper. Since the extrusion molding is performed in a matrix, a uniform profile with uniform wall thickness is guaranteed, since no flat stamping is performed after the encasing of the core as in the prior art, without enclosing the workpiece in a tool from all sides.

It will be understood that each of the elements described above, or two or more together, may also find a useful application in other types of constructions and methods differing from the types described above.

While the invention has been illustrated and described as embodied in an extrusion molded electrode formed as a compound body and a method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a method of producing a compound electrode for a spark plug, which has a core of a first electrically conductive material and a casing surrounding the core and composed of a second electrically conductive material, wherein initial starting bodies of a core and a casing having a circular contour are provided, and the casing is deformed on the core to surround the core, the improvement comprising performing the deformation of the casing on the core by a single step of extrusion molding the casing on the core with simultaneous shaping of the core and simultaneous formation of a rectangular cross-sectional profile of the electrode.

2. A method as defined in claim 1; and further comprising the step of first providing two starting elements formed as discs, to thereby provide said extrusion molding.

3. A method as defined in claim 1; and further comprising annealing the compound electrode after said extrusion molding.

* * * * *